US006746217B2

(12) United States Patent
Kim et al.

(10) Patent No.: US 6,746,217 B2
(45) Date of Patent: Jun. 8, 2004

(54) RECIPROCATING COMPRESSOR

(75) Inventors: Dong Han Kim, Seoul (KR); Byung Jik Kim, Seoul (KR); Hyeong Seok Kim, Seoul (KR); Jin Sung Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/041,497

(22) Filed: Jan. 10, 2002

(65) Prior Publication Data

US 2002/0119058 A1 Aug. 29, 2002

(30) Foreign Application Priority Data

Feb. 24, 2001 (KR) ..... 2001-9489

(51) Int. Cl.[7] ..... F04B 35/04
(52) U.S. Cl. ..... 417/417; 417/416; 417/520
(58) Field of Search ..... 417/416, 417, 417/520, 555.1, 902, 396, 397, 410.1, 415, 484, 506, 510, 545; 310/14, 15, 89, 91, 12, 13, 87, 88

(56) References Cited

U.S. PATENT DOCUMENTS 3,788,778 A * 1/1974 Miller ..... 417/417
4,027,211 A * 5/1977 Omura et al. ..... 318/127
4,836,757 A * 6/1989 Curwen et al. ..... 417/416
5,275,542 A * 1/1994 Terauchi ..... 417/417
6,089,836 A * 7/2000 Seo ..... 417/417
6,174,141 B1 * 1/2001 Song et al. ..... 417/312
6,491,506 B1 * 12/2002 Oh et al. ..... 417/417

* cited by examiner

*Primary Examiner*—Justine R. Yu
*Assistant Examiner*—John F Belena
(74) *Attorney, Agent, or Firm*—Birch, Stewart, Kolasch & Birch, LLP

(57) ABSTRACT

A reciprocating compressor includes a closed container having a suction tube and a discharge tube, and a reference frame elastically supported and mounted in the closed container. A driving motor is mounted at one end of the reference frame for generating a linear reciprocating driving force. A front frame is coupled to the other end of the reference frame which has a cylinder insertion hole therein. A cylinder is inserted into the cylinder insertion hole, and a piston is inserted in the cylinder. A connection magnet holder penetrates the reference frame, and an engaging portion engages the connection magnet holder and the piston. A discharge valve assembly is coupled to cover a compression space formed inside the cylinder and discharging gas, and a spring surrounds and is spaced from the piston for elastically supporting a motion of the piston. The operation mechanism is stable without any driving imbalance.

10 Claims, 5 Drawing Sheets

RECIPROCATING COMPRESSOR

BACKGROUND OF THE INVENTION

1. Field of the Invention

The present invention relates to a reciprocating compressor, and more particularly, to a reciprocating compressor that is capable of minimizing a loss of driving force, reducing noise occurrence, simplifying a structure and heightening a precision of assembly.

2. Description of the Background Art

In general, a refrigerating cycle unit is formed as a compressor, a condenser, expansion unit and evaporator, and the like, are sequentially connected by a connecting tube.

Among them, the compressor sucks and discharges a refrigerant gas. Depending on the method for compressing gas, there are various types of compressors including a rotary compressor, a reciprocating compressor and a scroll compressor, etc.

The compressor includes a closed container having an internal space, an electric mechanism part mounted in the closed container and generating a driving force, and a compression mechanism part compressing gas upon receiving the driving force of the electric mechanism part.

As shown in FIG. 1, in the rotary compressor, as a rotor 2 of the electric mechanism part (M) mounted in the closed container 1 is rotated, a rotational shaft 3 press-fit in the rotor 2 is rotated.

According to the rotation of the rotational shaft 3, in a state that a rolling piston 5 inserted in an eccentric portion 3*a* of the rotational shaft 3 positioned in the compression space (P) of the cylinder 4 is linearly in contact with a vane which is inserted at the inner circumferential surface of a compression space (P) of the cylinder 4 and one side of a cylinder 4, dividing the compression space (P) into a high pressure portion and a low pressure portion, the rolling piston 5 is rotated inside the compression space (P) of the cylinder 4.

In the rotation process, a series of processes in which the refrigerant gas is introduced into a suction hole 4*a* formed at one side of the cylinder 4, compressed in the compression space (P) and discharged through a discharge hole 4*b* positioned at one side of the compressor are repeatedly performed.

With reference to FIG. 2, in the reciprocating compressor, a rotor 12 of the electric mechanism part (M) mounted in the closed container 11 is rotated, a crank shaft 13 press-fit in the rotor 12 is rotated. As the crank shaft 13 is rotated, a piston 14 coupled to an eccentric portion 13*a* of the crank shaft 13 is linearly moved in the compression space (P) of the cylinder 14, compressing refrigerant gas sucked through a valve assembly 16 coupled to the cylinder 15, and at the same time, discharging the gas through the valve assembly 16, and this process is repeatedly performed.

With reference to FIG. 3, in the scroll compressor, as a rotor 22 of an electric mechanism part (M) mounted in a closed container 21 is rotated, a rotational shaft 23 provided with an eccentric part 23*a* press-fit at the rotor 22 is rotated.

According to the rotation of the rotational shaft 23, a revolving scroll 24 coupled to the eccentric portion 23*a* of the rotational shaft 23 is engaged with a fixed scroll 25 and makes a revolving movement, according to which a plurality of compression pockets formed by wraps 24*a* and 25*a* in an involute curve form respectively formed at the revolving scroll 24 and the fixed scroll 25 are made small, thereby successively sucking, compressing and discharging refrigerant gas. This process is repeatedly performed.

Problems of the rotary compressor, the reciprocating compressor and the scroll compressor operated in each compression mechanism will now be described in its structural aspect, performance aspect and reliability aspect.

First, the rotary compressor will now be described.

Referring to its structural aspect, the rolling piston 5 press-fit at the rotational shaft 3 having the eccentric portion 3*a* and at the eccentric portion 3*a* and a plurality of balance weights 6 coupled to the rotor 2 for a rotational balance of the eccentric portion 3 are used. Thus, as the parts are increased in number, its construction is complicated. In addition, since the sliding contact portion is wide, oil use amount is increased.

Referring to its performance, since the eccentric portion 3*a* of the rotational shaft 3 and the rolling piston 5 inserted into the eccentric portion 3*a* are positioned inside the compression space (P) of the cylinder 4, the compression volume is small compared to the compression mechanism part. In addition, when the rotational shaft 3 is rotated once, compression stroke is made by one time, so that the compression performance is low. Moreover, since a rotational torque becomes large as the plurality of balance weights 6 are attached, the loss of power is large.

Referring to its reliability, the eccentric portion 3*a* formed at the rotational shaft 3 and the rolling piston 5 are eccentrically rotated, so that a vibration noise is generated during the rotation.

Secondly, the reciprocating compressor will now be described.

Referring to its structural aspect, the crank shaft 13 provided with the eccentric portion 13*a*, the piston 14 coupled to the crank shaft 13 and the balance weight 13*b* for a rotational balance with the eccentric portion 13*a* formed at the crank shaft 13 are used. Thus, the number of parts is increased to complicate its structure. In addition, since the sliding contact area between the piston 14 and the cylinder 15 is wide, so that more oil is to be used.

Referring to its performance, the piston 14 compresses gas while being reciprocally moved in the compression space (P) formed in the cylinder 15, the compression discharge amount can be somewhat increased when the crank shaft 13 is rotated one time. But since one time of compression stroke is made for one time of rotation of the crank shaft 13, it's also inefficient. In addition, since the rotation torque becomes large by the eccentric portion 13*a* of the crank shaft 13 and the balance weight 13*b*, a loss in the driving power is large.

Referring to its reliability, since the eccentric portion 13*a* formed at the crank shaft 13 is eccentrically rotated, a vibration noise is generated. Also, since the valve assembly 16 is operated in sucking and discharging gas, the sucking/discharging noise is loud.

Lastly, the scroll compressor will now be described.

Referring to its structural aspect, since the rotational shaft 23 having the eccentric portion 23*a*, the revolving scroll 24 having the wraps in an involute curve form, and the balance weight 26 for a rotation balance of the fixing scroll 25 and the eccentric portion 23*a* are used, the parts are increased in number and its construction is complicated. In addition, processing of the revolving scroll 24 and the fixing scroll 25 is very difficult.

Referring to its performance and reliability, the plurality of compression pockets formed by the wrap 24*a* of the revolving scroll 24 and the wrap 25*a* of the fixing scroll 25 continuously compresses the refrigerant gas. Thus, the compression performance is desirable, but a vibration noise is generated due to the revolving movement of the revolving scroll and the eccentric movement appearing at the eccentric portion 23*a* formed at the rotational shaft 23.

SUMMARY OF THE INVENTION

Therefore, an object of the present invention is to provide a reciprocating compressor that is capable of minimizing a loss of driving force, reducing noise occurrence, simplifying a structure and heightening a precision of assembly.

To achieve these and other advantages and in accordance with the purpose of the present invention, as embodied and broadly described herein, there is provided a reciprocating compressor including: a closed container having a suction tube and a discharge tube connected thereto; a reference frame elastically supported and mounted in the closed container; a driving motor mounted at one side of the reference frame and generating a linear reciprocating driving force; a front frame coupled to the other side of the reference frame and having a cylinder insertion hole therein; a cylinder inserted into the cylinder insertion hole formed at a central portion of the front frame; a piston inserted in the cylinder to suck, compress and discharge a refrigerant gas; a connection type magnet holder positioned penetrating the reference frame; an engaging portion engaging the connection type magnet holder and the piston; a discharge valve assembly coupled to cover a compression space formed inside the cylinder and discharging gas; a spring position at both sides of the piston and elastically supporting a motion of the piston; and a suction valve coupled at an end portion of the piston and switching a refrigerant suction passage.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
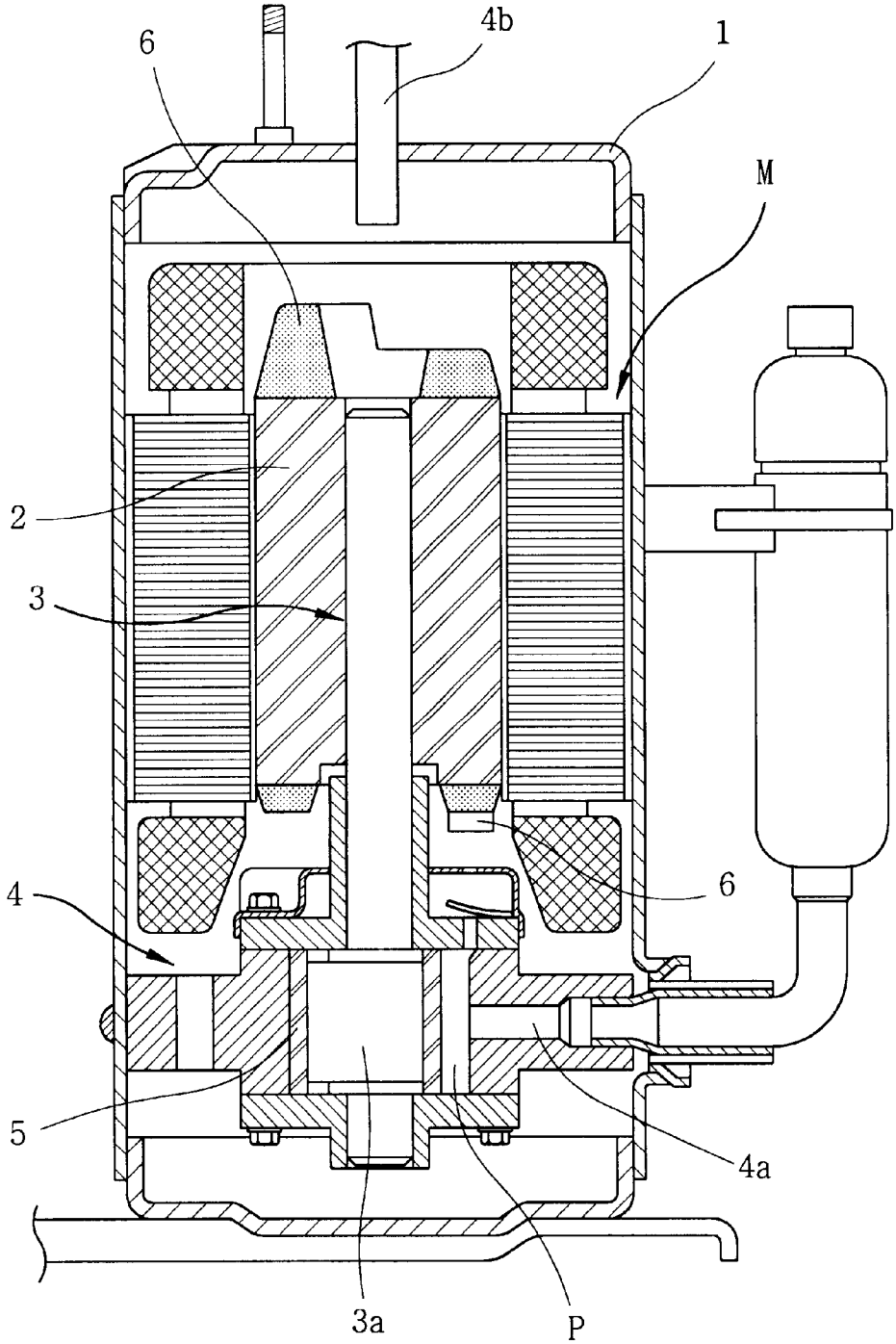
FIG. 1 CONVENTIONAL ART
FIG. 1 is a sectional view showing a general rotary compressor.
Figure 2:
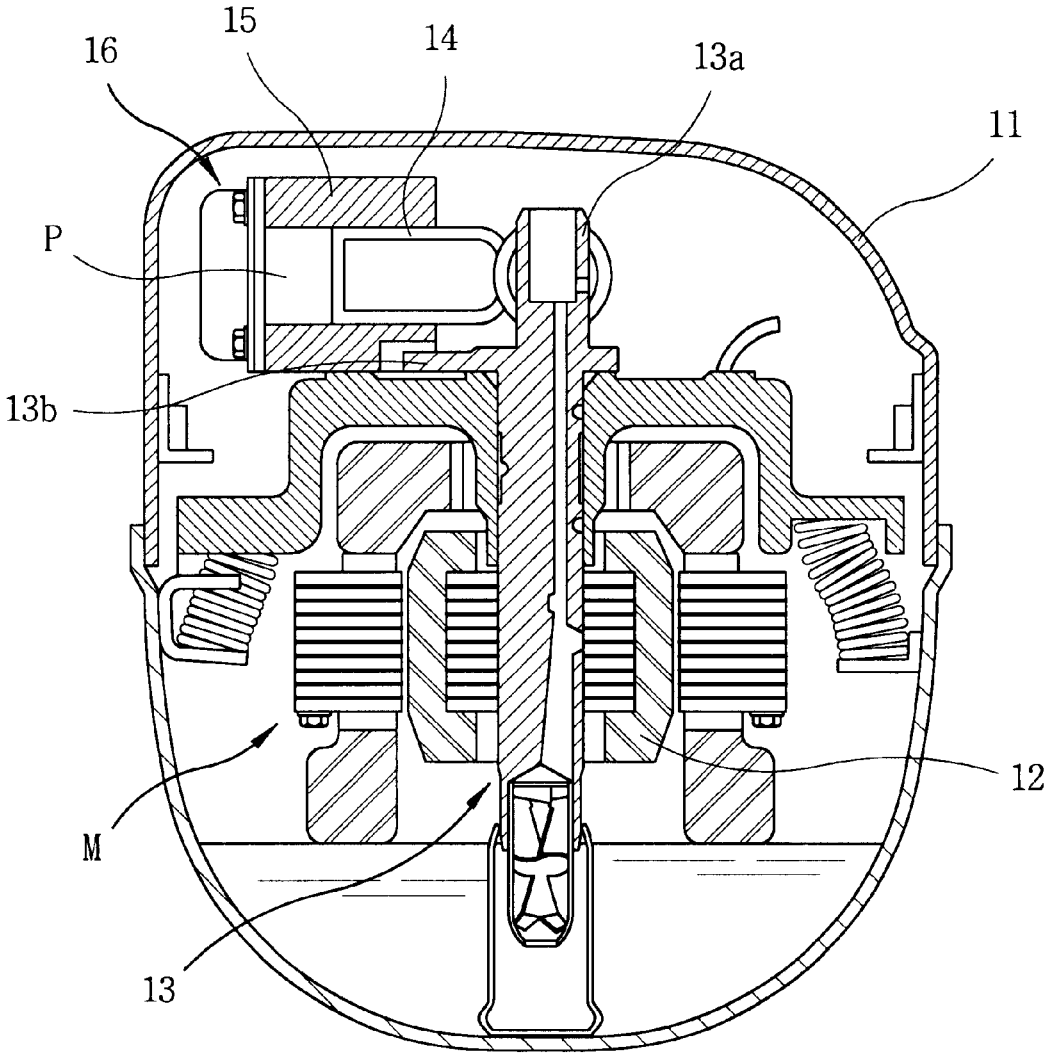
FIG. 2 CONVENTIONAL ART
FIG. 2 is a sectional view showing a general reciprocating compressor.
Figure 3:
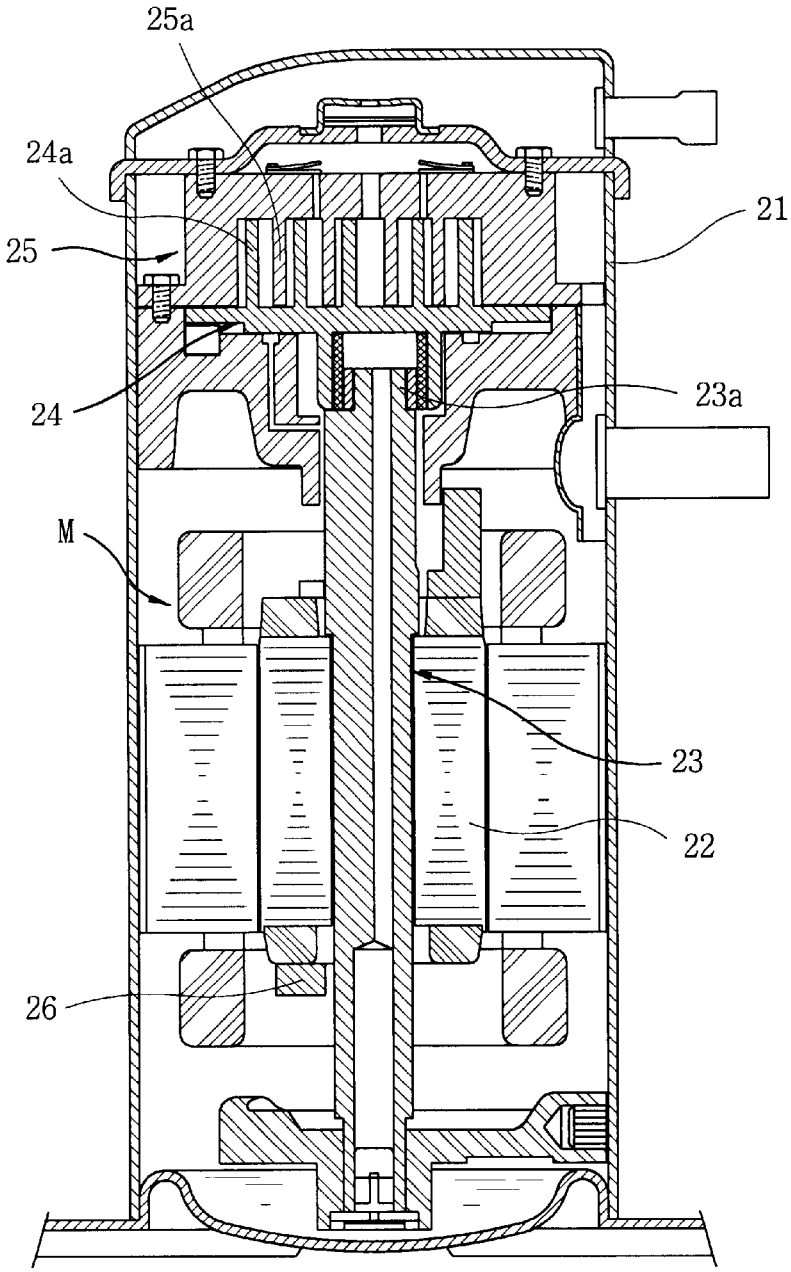
FIG. 3 CONVENTIONAL ART
FIG. 3 is a sectional view showing a general scroll compressor.
Figure 4:
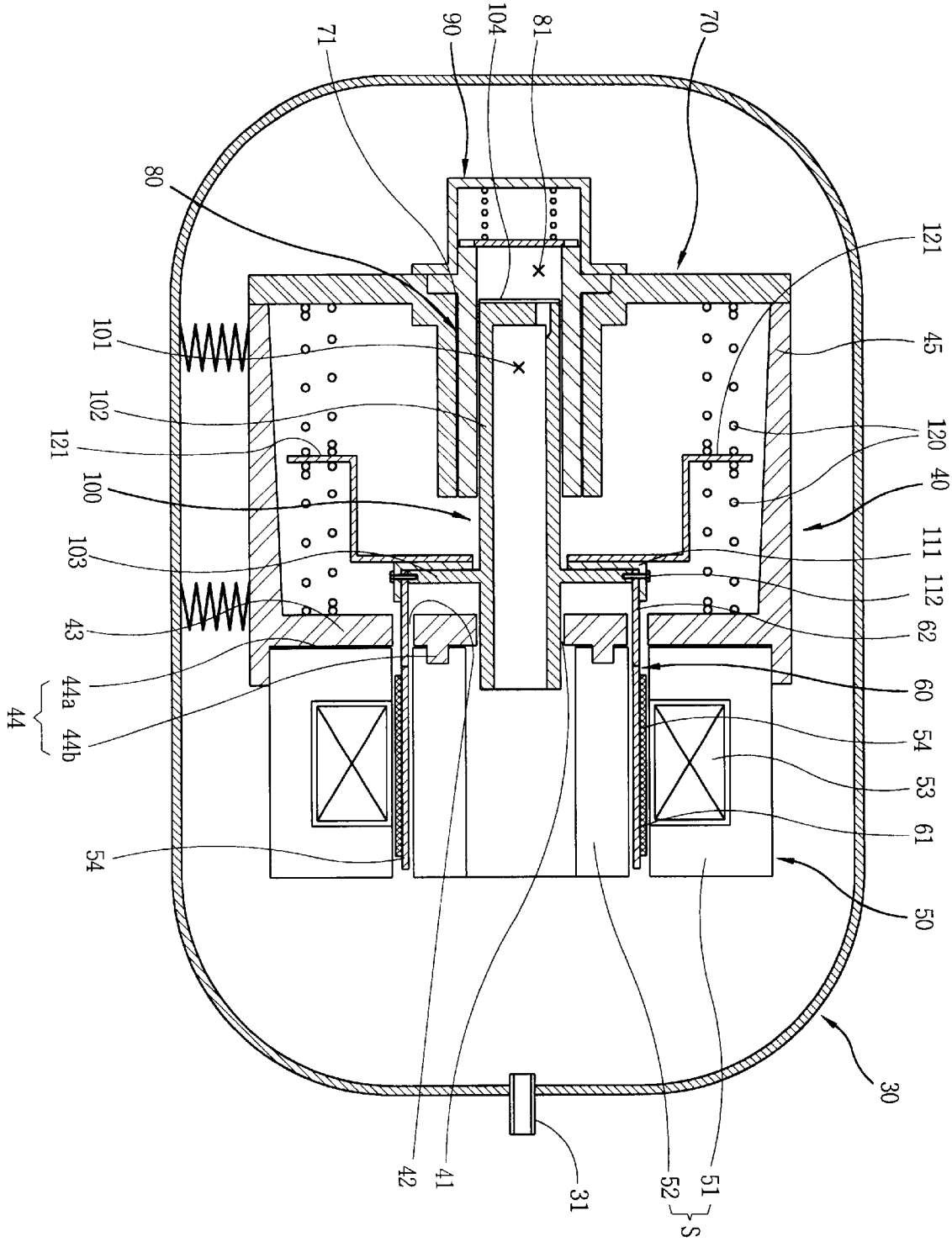
FIG. 4 is a sectional view showing a reciprocating compressor in accordance with a preferred embodiment of the present invention.

FIG. 4 is a sectional view showing a reciprocating compressor in accordance with a preferred embodiment of the present invention.

As shown in FIG. 4, a reciprocating compressor includes a closed container 30 and a suction tube 31 and a discharge tube (not shown) coupled to the closed container 30.

A reference frame 40 having a certain shape is elastically supported and mounted in the closed container 30.

Figure 5:
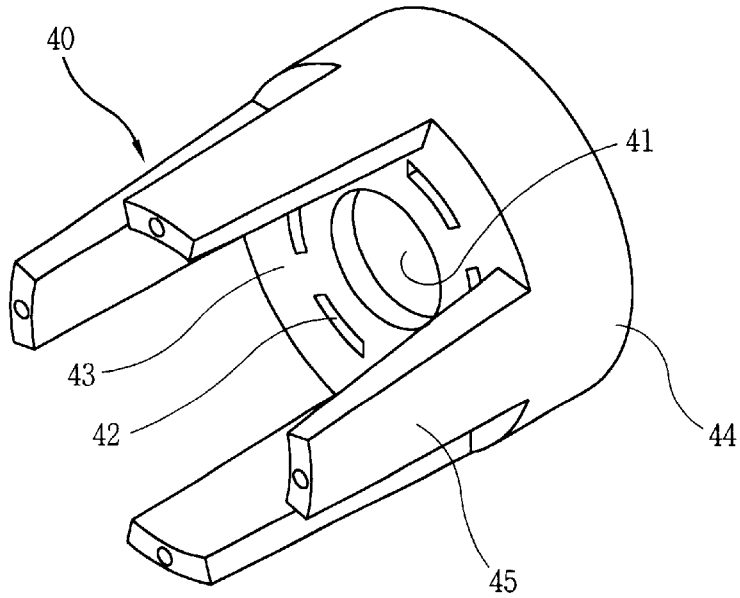
FIG. 5 is a perspective view showing a reference frame of the reciprocating compressor in accordance with the preferred embodiment of the present invention.

With reference to FIG. 5, the reference frame 40 includes a base portion 43 with a predetermined thickness and area having a communication hole 41 at its center and a plurality of connection holes 42 radially formed around the communication hole 41; a motor mounting portion 44 formed at one face of the base portion 43; and a plurality of fixing arms 45 extended in a certain length at the other side of the base portion 43.

The motor mounting portion 44 includes an outer motor mounting portion 44*a* positioned at an outer side of the reference frame 40 and depressed in a certain depth towards the left along the axial direction in FIG. 5; and an inner motor mounting portion 44*b* adjacent to the central portion to be positioned between the communicating hole 41 and the connection hole 42 and formed protruded to a predetermined height towards the left along the axial direction in FIG. 5 from the face parallel to the depressed face of the outer motor mounting portion 44*a*.

An outer core 51 in a hollow cylinder form is mounted at the outer motor mounting portion 44*a* of the reference frame 40 by a press-fitting method or the like.

An inner core 52 in a hollow cylinder form is inserted in the outer core 51 and coupled to the inner motor mounting portion 44*b* so as to be communicate with the communication hole 41 of the base portion 43.

The outer core 51, the inner core 52 and a winding coil 53 coupled inside the outer core 51 constitute a stator (S), and the connection type magnet holder 60 is inserted, as an armature, into the air gap between the outer core 51 and the inner core 52. The stator (S) and the connection type magnet holder 60, that is, the armature, constitute the driving motor 50.

Figure 6:
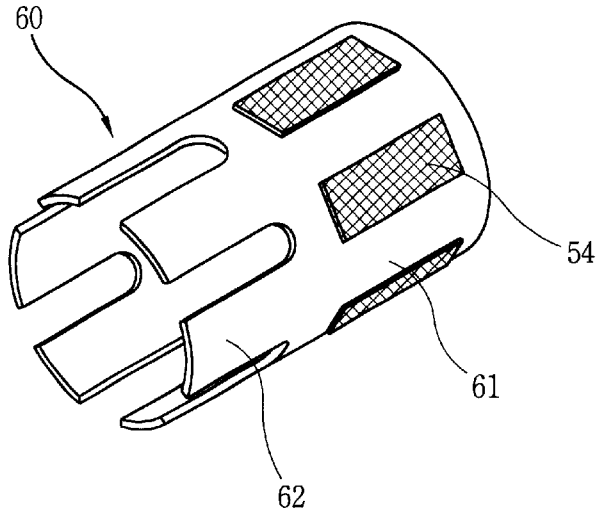
FIG. 6 is a perspective view showing a connection type magnet holder of the reciprocating compressor in accordance with the preferred embodiment of the present invention.

With reference to FIG. 6, the connection type magnet holder 60, that is, the armature, is formed to have a hollow cylindrical form.

A permanent magnet mounting portion 61 is formed at one end of the connection type magnet holder 60, and a plurality of connection feet 62 in a separated shape are formed corresponding to the position of the connection hole 42 at the other side of the connection type magnet holder 60.

The permanent magnet mounting portion 61 is inserted in a air gap between the outer core 51 and the inner core 52, and the plurality of connection feet 62 is inserted penetrating the connection hole 42 from the motor mounting portion 44 of the support frame 40 to the support frame 40.

A permanent magnet 54 is attached at an outer circumferential surface of the permanent magnet mounting portion 61 by adhesion or insertion.

A predetermined shape of front frame 70 is coupled to an end portion of the fixed arm 45 formed at one side of the reference frame 40.

The outer portion of the front frame 70 has a disk type form, and a cylinder insertion hole 71 is formed extended long in one direction at the center of the front frame 70.

The cylinder 80 having the compression space 81 is inserted into the cylinder insertion hole 71 in the direction that the cylinder insertion hole 71 is extended along the axial direction, and at the opposite side, a discharge valve assembly 90 for opening and closing the compression space 81 of the cylinder 80 is mounted at the end portion of the cylinder 80 along the axial direction.

A piston 100 is formed in a certain shape, of which one side end is inserted to be slidably moved in the compression space 81 of the cylinder 80 and the other end is inserted into the communication hole 41 of the reference frame 40.

The piston 100 includes an annular bar-type piston body 102 having a predetermined length, a refrigerant suction passage 101 penetratingly formed in the piston body 102 through which refrigerant gas flow, and a flange attachment portion 103 formed extended to have a predetermined area in the radial direction at an outer circumferential face of the piston body 102.

The connection feet 62 of the connection type magnet holder 60 is engaged at the flange attachment portion 103 formed at one side of the piston 100 by an engaging portion (to be described), and a suction valve 104 for opening and closing the refrigerant suction passage 101 is provided at an end portion of the other side thereof.

The engaging portion includes a combining cover 111 covering the flange attachment portion 103 of the piston 100 and the connection feet 62 of the connection type magnet holder 60 contacting and supporting the outer circumferential face of the flange attachment portion 103, and an engaging screw 112 engaging the combining cover 111 and the connection feet 62 with the flange attachment portion 103 together.

A spring support 121 having a predetermined shape is formed contacting one side of the combining cover 111.

A plurality of springs 120 are disposed between one face of the spring support 121 and the inner face of the base portion 43 of the reference frame 40 and between the other face of the spring support 121 and the inner face of the front frame 70, so as to elastically support a linear reciprocal movement of the piston 100.

The operational effect of the reciprocating compressor will now be described.

First, when power is applied and a current flows to the winding coil 53 of the driving motor 50, a flux is formed at the stator (S) due to the current flowing to the winding coil 53 and the armature is linearly moved according to the interaction between the flux and the permanent magnet 54 attached at the armature.

The movement is transmitted to the piston 100 through the connection type magnet holder 60, that is, the armature, so that the piston 100 is linearly moved in the compression space 81 of the cylinder 80.

According to the linear reciprocal movement of the piston 100, the valves are operated due to the pressure difference inside the compression space of the cylinder 80, according to which the refrigerant gas is sucked into the compression space 81 of the cylinder 80, compressed and discharged.

At this time, as the piston 100 is moved linearly and reciprocally, the spring 120 positioned a radial distance from the piston 100 is tensed and contracted to store and discharge the kinetic energy to an elastic energy, and at the same time, is resonated according to the operation frequency.

In the present invention, upon receiving the linear reciprocal driving force of the driving motor 50, the piston 100 is linearly and reciprocally moved in the compression space 81 of the cylinder 80, to suck, compress and discharge the refrigerant gas. Thus, the operation mechanism is stable without any driving imbalance. In addition, since the relative movement between parts, that is, portions where sliding contact occurs is less created, so that a frictional loss and a loss according to the driving are reduced and the noise is less generated. Thus, a stable and reliable operation can be performed.

Moreover, the number of the construction parts is reduced compared to that of the conventional art, so that the reciprocating compressor is compact.

Especially, since the mounted driving motor 50 and the mounted frame 70 use both sides ends of the reference frame 40, the structure is simplified and the assembly precision of the parts can be heightened.

That is, since the driving motor 50, the front frame 70, the cylinder 70 and the piston 100 are coupled at both ends of the reference frame 40, an accumulated tolerance is reduced and the assembly precision is improved.

As so far described, the reciprocating compressor of the present invention has many advantages.

That is, for example, first, the loss of power used for sucking, compressing and discharging the refrigerant gas is small, so that the power consumption amount can be reduced.

Secondly, the assembly precision is improved according to the reduction of the accumulated tolerance, so that the driving is stable.

Thirdly, as friction is reduced, noise generation is reduced and thus a reliability is improved.

Lastly, as the structure is simplified, the assembly productivity is improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A reciprocating compressor comprising:

a closed container having a suction tube and a discharge tube connected thereto;

a reference frame elastically supported and mounted in the closed container, the reference frame having a base and a generally cylindrical sidewall attached to and extending from a first end of the base;

a driving motor mounted on a second end of the base and outside of the generally cylindrical sidewall, the driving motor generating a linear reciprocating driving force;

a front frame coupled to the generally cylindrical sidewall of the reference frame opposite the driving motor and having a cylinder insertion hole therein;

a cylinder inserted into the cylinder insertion hole formed at a central portion of the front frame;

a piston inserted in the cylinder to suck, compress and discharge a refrigerant gas;

a connection magnet holder positioned penetrating the reference frame through connection holes in the base;

engaging means engaging the connection magnet holder and the piston;

a discharge valve assembly coupled to cover a compression space formed inside the cylinder and discharging gas;

a spring positioned a radial distance from an outside surface of the piston and elastically supporting a motion of the piston; and a suction valve coupled at an end portion of the piston and switching a refrigerant suction passage.

2. A reciprocating compressor comprising:

a closed container having a suction tube and a discharge tube connected thereto;

a reference frame elastically supported and mounted in the closed container;

a driving motor mounted at an one end of the reference frame and generating a linear reciprocating driving force;

a front frame coupled to the other end of the reference frame opposite the driving motor and having a cylinder insertion hole therein;

a cylinder inserted into the cylinder insertion hole formed at a central portion of the front frame;

a piston inserted in the cylinder to suck, compress and discharge a refrigerant gas;

a connection magnet holder positioned penetrating the reference frame;

engaging means engaging the connection magnet holder and the piston;

a discharge valve assembly coupled to cover a compression space formed inside the cylinder and discharging gas;

a spring positioned a radial distance from an outside surface of the piston and elastically supporting a motion of the piston; and a suction valve coupled at an end portion of the piston and switching a refrigerant suction passage, wherein the reference frame comprises:

base means with first and second ends, a predetermined thickness and surface area having a communication hole at its center and a plurality of connection holes radially formed around the communication hole;

motor mounting means having the driving motor at the second end of the base means; and a plurality of separated fixing arms extended in a certain length from the first end of the base means, at the end portions of which the front frame is fixed.

3. The compressor of claim 2, wherein the motor mounting means comprises:

an outer motor mounting portion positioned at an outer end of the reference frame and depressed at a certain depth along one direction of the axial direction of the piston; and an inner motor mounting portion positioned at a central portion, that is, between the communicating hole and the connection holes and formed protruded to a predetermined height along the other direction of the axial direction of the piston on the face parallel to the depressed face of the outer motor mounting portion.

4. A reciprocating compressor comprising:

a closed container having a suction tube and a discharge tube connected thereto;

a reference frame elastically supported and mounted in the closed container, the reference frame having a base and a generally cylindrical sidewall attached to and extending from a first end of the base;

a driving motor mounted at an one end of the reference frame and generating a linear reciprocating driving force;

a front frame coupled to the other end of the reference frame opposite the driving motor and having a cylinder insertion hole therein;

a cylinder inserted into the cylinder insertion hole formed at a central portion of the front frame;

a piston inserted in the cylinder to suck, compress and discharge a refrigerant gas;

a connection magnet holder positioned penetrating the reference frame through connection holes in the base;

engaging means engaging the connection magnet holder and the piston;

a discharge valve assembly coupled to cover a compression space formed inside the cylinder and discharging gas;

a spring positioned a radial distance from an outside surface of the piston and elastically supporting a motion of the piston; and a suction valve coupled at an end portion of the piston and switching a refrigerant suction passage, wherein the connection magnet holder includes permanent magnet mounting means formed at one end and a separate connection feet formed corresponding to a connection hole at another end thereof.

5. A reciprocating compressor comprising:

a closed container having a suction tube and a discharge tube connected thereto;

a reference frame elastically supported and mounted in the closed container;

a driving motor mounted at an one end of the reference frame and generating a linear reciprocating driving force;

a front frame coupled to the other end of the reference frame opposite the driving motor and having a cylinder insertion hole therein;

a cylinder inserted into the cylinder insertion hole formed at a central portion of the front frame;

a piston inserted in the cylinder to suck, compress and discharge a refrigerant gas;

a connection magnet holder positioned penetrating the reference frame;

engaging means engaging the connection magnet holder and the piston;

a discharge valve assembly coupled to cover a compression space formed inside the cylinder and discharging gas;

a spring positioned a radial distance from an outside surface of the piston and elastically supporting a motion of the piston; and a suction valve coupled at an end portion of the piston and switching a 3', refrigerant suction passage, wherein the engaging means comprises:

a flange attachment portion formed radially extended to have a predetermined width and a circular surface area at the outer circumferential portion of the body of the piston and connection feet of the connection magnet holder contacts and supports a flange outer circumferential surface;

a combining cover covering the connection feet of the connection magnet holder supportedly contacting the flange attachment portion and one side of a flange combining part; and an engaging screw engaging the combining cover and the connection feet with the flange combining part.

6. The compressor of claim 1, wherein the generally cylindrical sidewall is segmented and comprises a plurality of separated fixing arms extended in a certain length from the first end of the base, at the end portions of which the front frame is fixed.

7. The compressor of claim 1, wherein the base has a predetermined thickness and surface area having a communication hole at its center and a plurality of connection holes radially formed around the communication hole.

8. The compressor of claim 7, wherein the reference frame includes motor mounting means which comprises:

an outer motor mounting portion positioned at an outer end of the reference frame and depressed a certain depth along one direction of the axial direction of the piston; and an inner motor mounting portion positioned at a central portion, that is, between the communicating hole and the connection hole and formed protruded to a predetermined height along the other direction of the axial direction of the piston on the face parallel to the depressed face of the outer motor mounting portion.

9. The compressor of claim 1, wherein the connection magnet holder includes permanent magnet mounting means formed at one end and separate connection feet formed corresponding to a connection hole at another end thereof.

10. The compressor of claim 1, wherein the engaging means comprises:

a flange attachment portion formed radially extended to have a predetermined width and a circular surface area at the outer circumferential portion of the body of the piston and connection feet of the connection magnet holder contacts and supports a flange outer circumferential surface;

a combining cover covering the connection feet of the connection magnet holder contacting and supporting the flange attachment portion and one side of the flange combining part; and an engaging screw engaging the combining cover and the connection feet with the combining part.

* * * * *